United States Patent [19]

Schentrup

[11] Patent Number: 4,708,682

[45] Date of Patent: Nov. 24, 1987

[54] HELICOPTER TOY

[76] Inventor: Lawrence M. Schentrup, 402 E. Parkland Ave., Evansville, Ind. 47711

[21] Appl. No.: 892,710

[22] Filed: Jul. 31, 1986

[51] Int. Cl.[4] ..... A63H 27/00

[52] U.S. Cl. ..... 446/36; 446/31; 446/66

[58] Field of Search ..... 446/36, 66, 31, 61

[56] References Cited

U.S. PATENT DOCUMENTS

| | | | |
|---|---|---|---|
| D. 158,936 | 6/1950 | Crowder | 446/36 |
| D. 169,558 | 5/1953 | Nagler | 446/36 |
| 1,245,279 | 11/1917 | Shrum . | |
| 1,775,252 | 9/1930 | Pennick | 446/66 |
| 2,035,629 | 3/1936 | Wing . | |
| 2,739,414 | 3/1956 | Cleveland | 446/66 |
| 2,876,585 | 3/1959 | Zaic | 446/66 |
| 2,885,206 | 5/1959 | Ensley | 446/31 |
| 3,092,359 | 6/1963 | Pohl | 446/61 |
| 3,770,229 | 11/1973 | Seefluth | 446/36 |
| 3,814,431 | 6/1974 | Callahan . | |
| 4,216,962 | 8/1982 | Flemming . | |
| 4,246,721 | 1/1981 | Bowers . | |
| 4,248,007 | 2/1981 | Gamburd | 446/66 |
| 4,345,401 | 8/1986 | Brzack . | |
| 4,421,320 | 12/1983 | Robson . | |
| 4,531,323 | 7/1985 | Henning . | |

*Primary Examiner*—Victor N. Sakran

*Attorney, Agent, or Firm*—Jeffers, Hoffman & Niewyk

[57] ABSTRACT

A helicopter toy including a hollow body which forms an elongated conduit. A generally elongated planar tail member is secured to the body at one end of the body and is axially aligned with the body. The tail member also includes a generally planar flap secured thereto. The flap is generally horizontal and is arranged at any angle to the plane of the tail. A multi-bladed, boomerang-shaped propeller is rotatably secured to the body so that the body is suspended from the propeller. The toy may be thrown to describe a curved flight path, whereby the toy will return to the operator, or different flight patterns depending on the selected propeller. Air passes through the hollow body to continually keep the hollow body aligned with the path of flight of the toy.

8 Claims, 10 Drawing Figures

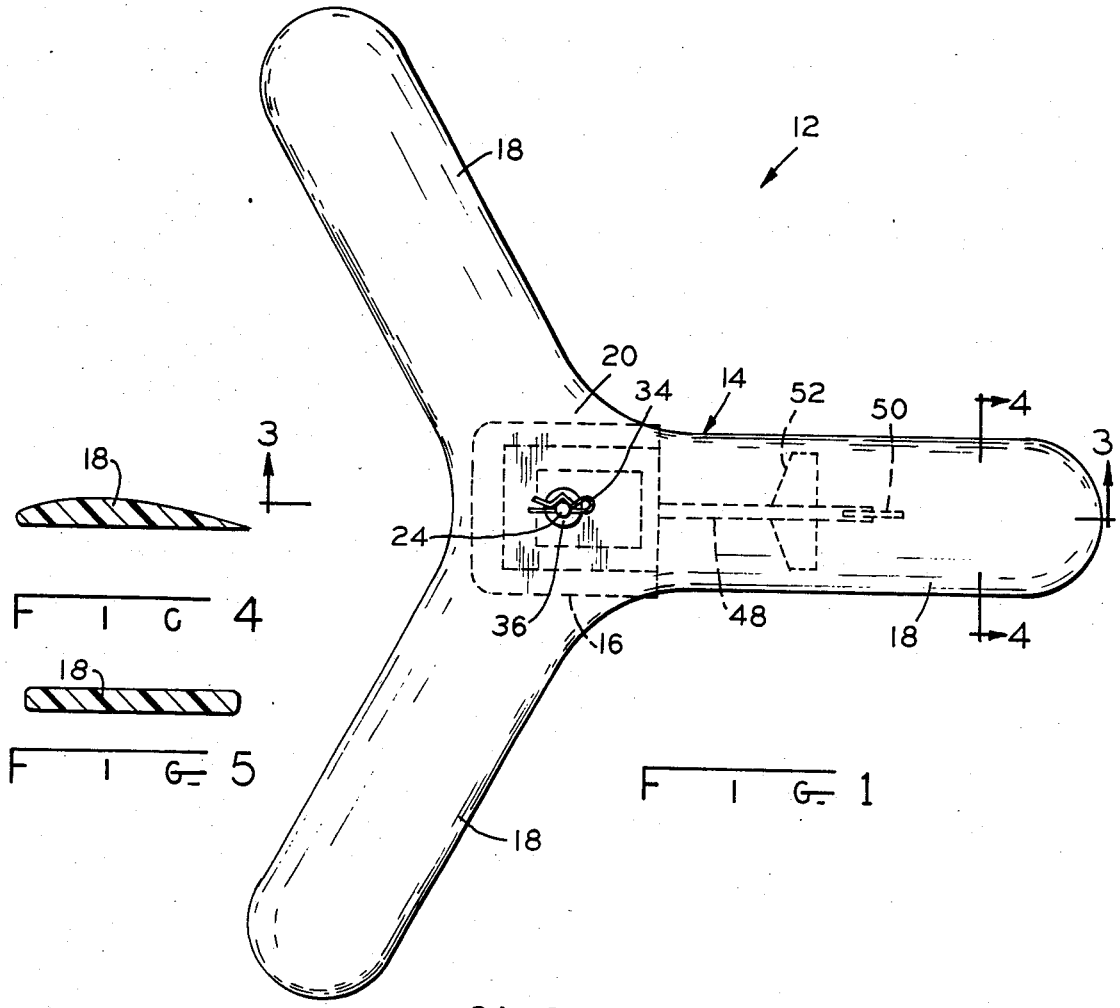
FIG 1
FIG 4
FIG 5
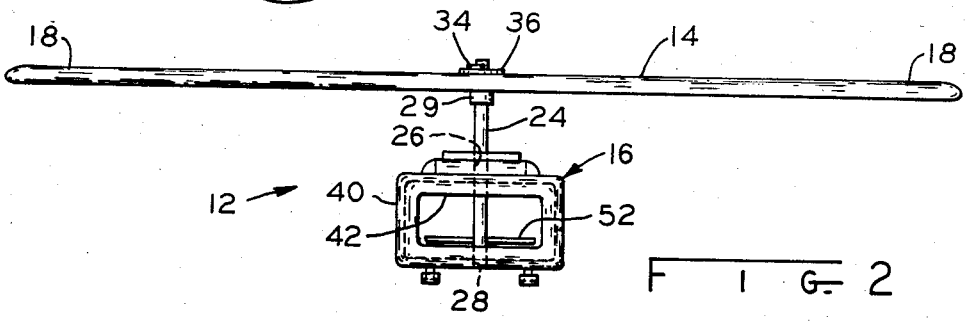
FIG 2
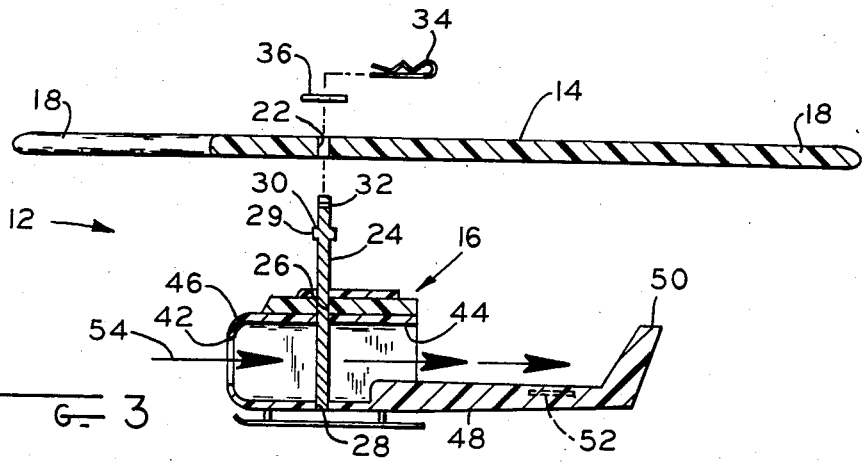
FIG 3

HELICOPTER TOY

BACKGROUND OF THE INVENTION

This invention relates to a toy and more particularly to a helicopter toy which can be launched or thrown into the air to describe a flight or glide path. More specifically, this invention relates to a helicopter toy which is formed by combining a boomerang and a hollow glider body and which can describe a desired flight path which depends on propeller selection.

Prior art hollow bodied glider toys have been provided which describe a flight or glide path when thrown into the air. One example of such a toy is shown in U.S. Pat. No. 4,345,401 wherein the shape of the hollow glider body is specially configured to provide an advantageous construction. A problem with this type of toy is that the toy, when thrown, does not return to the point from which it is thrown so that the operator will need to continually move about to retrieve the toy. Furthermore, the toy may become lost when the operator is operating the toy near water or other areas from which the toy may not be retrieved.

Boomerang toys have also been provided which generally are comprised of multiple blades and which can be thrown into the air and will then return to the player in a curved flight path. Most of these boomerang toys comprise only a propeller which may comprise three blades as shown, for instance, in U.S. Pat. No. 4,421,320. A disadvantage of this type of toy is the relative unattractive appearance of the toy and, furthermore, the fact that the toy does not realistically simulate any known, heavier than air flight machine such as an airplane or a helicopter.

Other boomerang toys have been provided wherein a solid body has been attached to the propeller so that the toy more realistically simulates an actual heavier than air flight machine such as a helicopter. One example of such a toy is shown in U.S. Pat. No. 2,035,629. While the toy disclosed in this patent is advantageous in that it simulates the appearance of an actual flight machine and furthermore has the advantage that it describes a curved flight path to return to the operator, a disadvantage of this toy is that it is provided with a solid body. First of all, and most importantly, the solid body does not align itself very readily with the direction of flight of the toy so that the toy may appear to be unrealistic in its simulation of an actual helicopter and therefore less attractive. Secondly, such a solid body makes the toy relatively heavy whereby the flight path which can be described by the toy is unnecessarily limited by the weight of the toy. Lastly, because of the increased weight of the toy, it may be more difficult to operate, particularly for small persons and children.

It is, therefore, desired to provide a helicopter toy which comprises a hollow body and a boomerang propeller, thereby combining the advantages of both hollow gliders and boomerangs.

SUMMARY OF THE INVENTION

The present invention overcomes the disadvantages of the above-described prior art glider toys and boomerangs by providing a boomerang helicopter toy including a hollow body.

The toy according to the present invention, in one form thereof, includes a multi-bladed, boomerang-shaped propeller which is rotatably secured to a hollow body so that the hollow body is suspended from the propeller. The propeller may be selected to achieve various desired flight paths. The hollow body forms a elongated conduit-shaped passage so that air will pass through the hollow body and thereby cause the hollow body to align with the flight path of the toy at all times. Furthermore, to increase the realism of the toy in its simulation of an actual helicopter, a vertically oriented, planar tail member is secured to the aft portion of the conduit and a pair of planar flaps are secured to the tail thereby further improving the alignment of the body with the flight path of the toy.

An advantage of the toy according to the present invention is that the hollow body will aid in the alignment of the toy body with the direction of flight of the toy, thereby giving the toy a more realistic appearance and simulating an actual helicopter.

Another advantage of the present invention is that the toy is lighter in weight than prior art helicopter toys by virtue of the hollow body and therefore may both be thrown more easily by small persons and children than prior art solid bodied helicopter toys and, furthermore, will cause the toy to describe a longer flight path than would be possible with the relatively heavy prior art solid-bodied helicopter toys.

A further advantage of the toy according to the present invention is that the propeller may be boomerang-shaped whereby the toy can describe a curved flight path and will return to the player as it is thrown into the air, thereby preventing loss of the toy when it is used in areas adjacent bodies of water and the like and making the toy more enjoyable to use. Conversely, other types of propellers may be used for achieving other types of flight patterns.

The present invention, in one form thereof, comprises a helicopter toy including a hollow body in the form of an open ended, elongated conduit. A generally elongated planar tail member is secured to the body, the tail member being vertically arranged in axial alignment with the conduit. A generally planar flap is secured to the tail member and is arranged generally horizontally and at right angles to the plane of the tail member. A multi-bladed, boomerang-shaped propeller is rotatably secured to the body whereby the body is suspended from the propeller.

The present invention, in one form thereof, further comprises a helicopter toy including a hollow body, a boomerang including a plurality of blades, such as, for instance, 3, 4, or 5 blades and a shaft for rotatably securing the boomerang to the hollow body.

The helicopter toy according to the present invention, in one form thereof, comprises a rotatable multi-bladed boomerang propeller and a hollow conduit body suspended from the boomerang propeller. The body is adapted for air flow therethrough so that it will align axially with the direction of flight of the toy during the flight of the toy. A tail member is secured to the body at the trailing side of the hollow conduit.

It is an object of the present invention to provide a helicopter toy including a hollow body and a boomerang propeller whereby the toy will describe a curved or straight flight path, depending on the choice of propellers, whereby air will flow through the hollow body and the hollow body will align with the direction of flight of the toy.

It is an object of the present invention to provide a helicopter toy with a hollow body so that the toy is lighter in weight than prior art solid-bodied helicopter toys.

It is a further object of the present invention to provide a helicopter toy, which simulates a helicopter, is realistic in appearance, and which, furthermore, operates more satisfactorily than prior art helicopter toys.

BRIEF DESCRIPTION OF THE DRAWINGS

FIG. 1 is a plan view of the helicopter toy according to the present invention;

FIG. 2 is a front elevational view of the helicopter toy according to the present invention;

FIG. 3 cross sectional view of the helicopter toy of FIG. 1 taken along lines 3—3 of FIG. 1;

FIG. 4 a cross sectional view of one embodiment of a propeller blade of the helicopter toy taken along lines 4—4 of FIG. 1;

FIG. 5 is a cross sectional view of another embodiment of a propeller blade of the helicopter toy taken along lines 4—4 of FIG. 1;

Corresponding reference characters indicate corresponding parts throughout the several views of the drawings.

Figure 6:
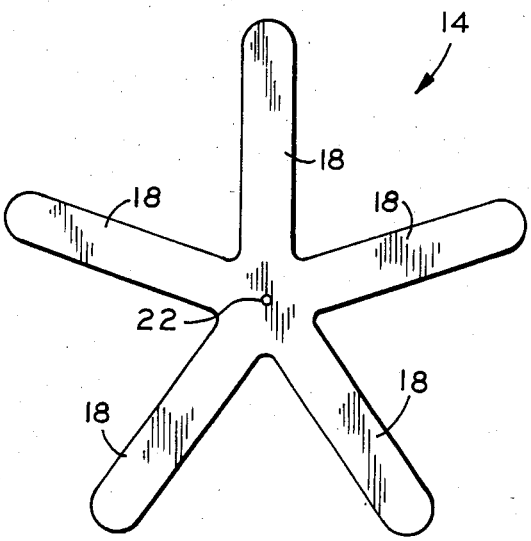
FIG. 6 is an alternative embodiment of the propeller for the helicopter toy of FIG. 1.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Referring to FIGS. 1-3, there is shown a helicopter toy 12 including a boomerang 14 and a body 16. The boomerang, in the disclosed embodiment, comprises a propeller including three blades 18 which are joined at a central section 20. As best seen in FIG. 4, the blades 18 may be shaped as air foils to provide sufficient lift to enable the toy to describe a relatively long curved flight path as the blades rotate.

As seen in FIG. 5, the blades 18 may also be shaped as shown wherein the top and bottom surfaces are parallel and whereby the flight of the helicopter will be semi-straight.

Central section 20 of boomerang 16 includes an aperture 22 in which is disposed a shaft 24. Shaft 24 is also disposed in apertures 26 and 28 in body 16 and is secured to body 16 whereby shaft 24 will not rotate with respect to body 16. Such securement of shaft 24 may be effected by either a press fit into apertures 26, 28 or by means of a suitable adhesive material.

Shaft 24 also includes an enlarged section 29 which provides a shoulder 30 on which rests the central section 20 of boomerang 14. Shaft 24 includes a pin aperture 32 in which a pin such as a cotter pin 34 is disposed. A washer 36 is provided between cotter pin 34 and central section 20 of boomerang 14. Thus, as best seen in FIG. 2, body 16 is suspended below blade 14 when the toy helicopter 12 is in flight whereby boomerang 14 will support body 16 by means of shaft 24. Furthermore, boomerang 14 is rotatable with respect to body 16 by being journalled on shaft 24 by means of the support shoulder 30 and washer 36 which provides bearing surfaces for boomerang 14.

Referring now to FIGS. 2 and 3, it can be seen that body 16 is hollow. As best seen in FIG. 3, body 16 is somewhat elongated to form an elongated passage or conduit 40 so that air will flow through apertures 42 and 44 and conduit 40 whereby conduit 40 axially aligns with the direction of flight of body 16 as the toy 12 describes a flight path. Air flowing through conduit 40 is indicated by arrows 54 in FIG. 3. Conduit 40 includes curved portions 46 at the front edge thereof for streamlining and appearance purposes. A tail 48 is secured to body 16 by means of adhesive or the like. Tail 48 may also be formed integrally with body 16. Tail 48 comprises a planar member which is generally vertically upstanding to make the toy appear more realistic, to provide stability during flight and to aid in alignment of body 16 with the flight path of the toy. Tail 48 also includes an upstanding portion 50 which may be formed integrally with tail member 48 or may be secured thereto by an adhesive or other suitable fastening method. A pair of planar flaps 52 are secured to tail 48 generally horizontally and at right angles thereto as best seen in FIG. 2 to add realism to the appearance of the toy.

The entire toy 12 may be manufactured from suitable plastic material such as, for instance, low density, lightweight polypropolene or polyethylene. Similarly, the body 16 may be formed of balsa wood to provide a body which is very light in weight. Blades 18 of boomerang 14 are relatively narrow in width as compared to conventional boomerangs and blades 18 are relatively long as compared to the length of the body of body 16 to give increased lift to the toy and to improve the flight capabilities of the toy. The blades are relatively thin and may be, for instance, in the range of 3/16 inch to ⅛ inch, to reduce the weight of the toy as much as possible. However, care should be taken not to make the blades too thin or too light in weight for satisfactory operation of the toy. The blades may also extend at a pitch with respect to the central section 20, similarly to normal helicopter propellers. The pitch is preferably in the range of 1/16 inch to 3/16 inch.

In operation, when it is desired to operate the toy, one of blades 18 is grasped at its tip and the operator then throws the toy into the air with boomerang 14 at a generally inclined angle with respect to the horizontal. Blades 18 will rotate and toy 12 will describe a flight path which is inclined with respect to the horizontal so that the toy will fly upwardly in an inclined plane. By proper selection of a propeller blade shape, the toy may be caused to fly in a curved path, to return to the operator, or to fly in a straight path. By virtue of the shape of conduit 40, which is somewhat elongated and hollow, as well as tail 48, body 16 will align itself with the flight path of toy 12 so that the helicopter at all times appears to simulate a real helicopter with blades 18 rotating and with body 16 aligned with the flight path of toy 12. As shown in FIG. 3, by arrows 54, air flows through conduit 40 during flight to aid in aligning body 16 with the flight path of the toy.

Figure 7:
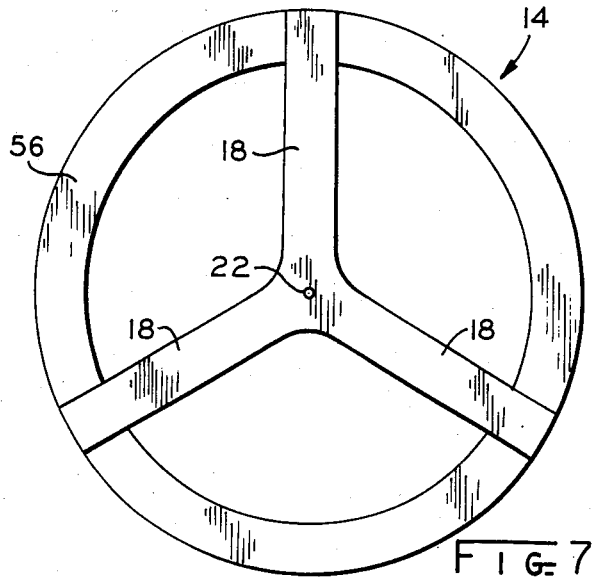
FIG. 7 is an alternative embodiment of the propeller for the helicopter FIG. 1.
Figure 8:
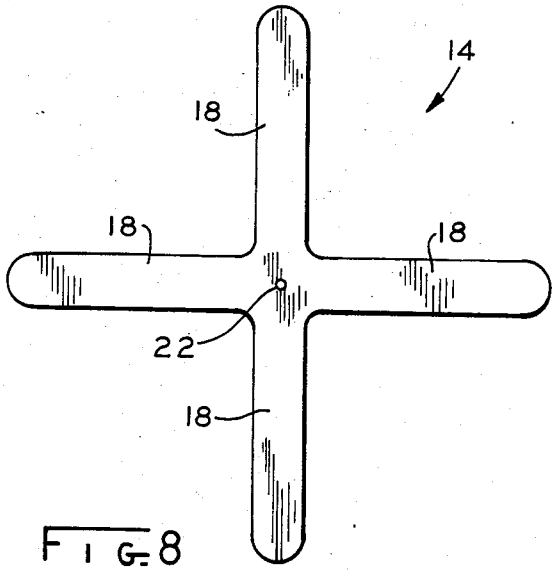
FIG. 8 is an alternative embodiment of the propeller for the helicopter toy of FIG. 1.
Figure 9:
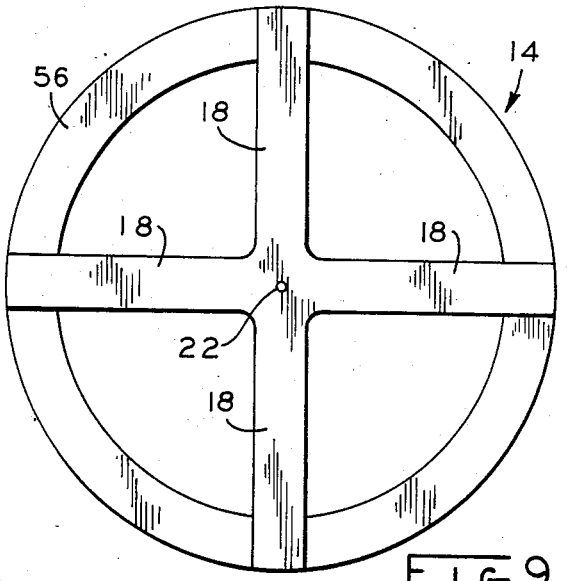
FIG. 9 is an alternative embodiment of the propeller for the helicopter toy of FIG. 1.
Figure 10:
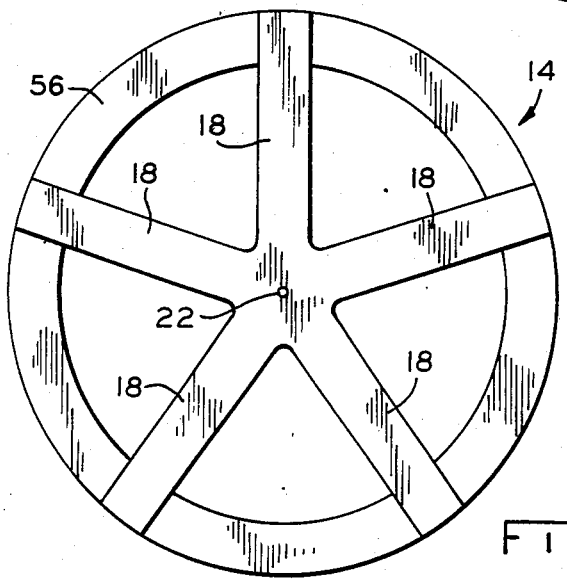
FIG. 10 is an alternative embodiment of the propeller for the helicopter toy of FIG. 1.

Referring now to FIGS. 6-10, various alternative shapes for the propeller of the helicopter are shown. Thus, in FIG. 6, a five-bladed propeller is shown. In FIG. 7 a three-bladed propeller is shown wherein the tips of the blades are connected together by a ring portion 56. FIG. 8 shows a four-bladed propeller. FIG. 9 shows a four-bladed propeller wherein the tips are connected by a ring portion 56. FIG. 10 shows a five-bladed propeller wherein the tips of the blades are connected together by a ring portion 56. The blades of the propellers of FIGS. 6–10 may be shaped either as shown in FIG. 4 or as shown in FIG. 5 depending upon the type of flight, either curved or straight, which is desired. Furthermore, the size of the propeller may, of course, be changed whereby more or less lift will be effected for the toy. The propellers shown in FIGS. 7, 9, and 10, wherein a ring connects the tips of the blades, are mainly used for straight flight. All of the propellers have rounded edges for semi-straight flight.

It should be understood, of course, that the shape of conduit 40 may be tubular or any other desired shape for ease in manufacturing and also for providing an attractive and realistic toy.

Thus, a helicopter toy has been provided which is easy to operate, inexpensive to construct and provides a realistic simulation of an actual helicopter.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which the invention pertains and fall within the limits of the appended claims.

What is claimed is:

1. A helicopter toy comprising:

a hollow body comprising an open ended, elongated conduit;

a generally elongated planar tail member secured to said body, said tail member being vertically arranged in axial alignment with said conduit;

said tail member having a generally planar member secured thereto, said planar member being generally horizontally arranged and at right angles to the plane of said tail member; and a multi-bladed, boomerang-shaped propeller rotatably secured to said body, whereby said body is suspended from said propeller, and whereby air flows through said conduit during flight of said toy and whereby said body is axially aligned with the flight path of said toy.

2. The helicopter toy according to claim 1 wherein said plurality of blades comprises from three to five blades.

3. The helicopter toy according to claim 1 wherein said hollow body is generally shaped to simulate the shape of a helicopter body.

4. A helicopter toy comprising:

a hollow body comprising an elongated conduit;

a generally planar tail member secured to said hollow body;

a boomerang including a plurality of blades; and means for rotatably securing said boomerang to said hollow body, wherein said conduit is arranged in axial alignment with the generally elongated tail member, whereby the conduit and tail member will align with the direction of flight of said helicopter toy and whereby air will pass through said conduit during the flight of said helicopter toy.

5. The helicopter toy according to claim 4 including a generally planar flap secured to said tail member, the plane of said tail member being oriented at an angle to the plane of said flap.

6. The helicopter toy according to claim 4 wherein said plurality of blades comprises from three to five blades.

7. The helicopter toy according to claim 4 wherein said hollow body is suspended below said boomerang.

8. The helicopter toy according to claim 4 wherein said hollow body is generally shaped to simulate the shape of a helicopter body.

* * * * *